United States Patent [19]

Barton et al.

[11] Patent Number: 4,803,926

[45] Date of Patent: Feb. 14, 1989

[54] DOUBLE RAMMING PROJECTILE ASSEMBLY FOR GUNS

[75] Inventors: Arthur E. M. Barton; Spencer D. Meston, both of Bristol, United Kingdom

[73] Assignee: British Aerospace PLC, London, England

[21] Appl. No.: 870,014

[22] Filed: Jun. 3, 1986

[30] Foreign Application Priority Data

Jun. 4, 1985 [GB] United Kingdom ..... 8514032

[51] Int. Cl.[4] ..... F42B 5/02

[52] U.S. Cl. ..... 102/430; 102/434

[58] Field of Search ..... 102/340, 342, 351, 357, 102/430, 434, 437, 439, 443, 444, 446, 447, 532; 89/1.701, 33.04

[56] References Cited

U.S. PATENT DOCUMENTS

| | | | |
|---|---|---|---|
| 372,678 | 11/1887 | Hurst | 102/443 |
| 2,321,866 | 6/1943 | Sheldon | 102/340 |
| 3,981,093 | 9/1976 | Reed | 42/105 |
| 4,044,863 | 8/1977 | Feldman | 102/351 |
| 4,173,186 | 11/1979 | Dunham | 102/430 |
| 4,197,801 | 4/1980 | LaFever | 102/433 |
| 4,335,657 | 6/1982 | Bains | 102/443 |

FOREIGN PATENT DOCUMENTS

| | | |
|---|---|---|
| 944047 | 3/1949 | France . |
| 892831 | 3/1962 | United Kingdom . |

OTHER PUBLICATIONS

European Search Report EP 86 30 4187, dated 15-0-7-1986.

*Primary Examiner*—Harold J. Tudor

*Attorney, Agent, or Firm*—Cushman, Darby & Cushman

[57] ABSTRACT

A projectile assembly comprising a carrier and a projectile arranged for insertion in the unmodified breech of a gun, the carrier having a ramming piston which urges the projectile into the barrel of the gun ready for firing whereupon the carrier is ejected and replaced by a propellant cartridge for firing the projectile from the barrel. The assembly is suitable for use in a belt fed automatic gun in which projectile assemblies are alternately interspersed with propellant cartridges such that a projectile is placed in the gun barrel by the projectile carrier, the carrier is ejected and then the next item on the belt, a propellant cartridge is placed in the breech for firing the gun.

6 Claims, 1 Drawing Sheet

DOUBLE RAMMING PROJECTILE ASSEMBLY FOR GUNS

This invention relates to a projectile assembly which enables a double ramming technique to be used not only in non-automatic guns but in automatic guns as well.

Where a known projectile assembly, that is to say a projectile and an attached propellant cartridge, is introduced into a gun by way of a breech mechanism it is found that lengthening the assembly is not possible without major modification of the breech mechanism. Such increases in length result from extra volume being required to accommodate for example guidance equipment in the projectile and/or extra propellant in the cartridge.

Hitherto such increases have been accommodated by using a double ramming technique in which, in a first stage, the projectile is introduced into the breech mechanism and from there into the barrel, and, in a second stage, is followed by the insertion of a separate propellant cartridge into the breech mechanism which is then ignited to urge the projectile from the barrel.

This technique is adequate for non-automatic weapons but is unsuitable for automatic weapons; thus one objective of the present invention is the provision of a projectile assembly which enables a double ramming technique to be used in existing automatic guns without requiring major modification of the breech mechanism and, moreover, does not require major modification of the ammunition feed. Naturally, it is most desireable that the invention involves no modification to existing equipment at all.

According to the present invention there is provided a projectile assembly for insertion into a gun of the type having a breech and a barrel, the assembly including a projectile carrier, a projectile slidably carried therein, and urging means and control means by which the projectile is urged from the carrier in a controlled manner, whereby when the projectile assembly is inserted into the breech of a gun, the projectile can be urged a predetermined distance into the barrel, and the projectile carrier subsequently ejected from the breech.

By this arrangement, the first stage of a double ramming technique can be effected since the assembly of a projectile and its carrier can be formed of a length acceptable by the breech mechanism of an existing gun. In use, when the assembly is inserted in a breech mechanism, the carrier can urge the projectile into the gun barrel in a controlled manner ready for firing from the gun and then the spent carrier can be removed.

Subsequently, the second stage of the double ramming technique can be effected by the provision of a separate propellant cartridge (not being part of this invention), formed to be accepted by the breech mechanism, and inserted in the breech mechanism subsequent to removal of the spent carrier to expel the already inserted projectile from the barrel, that is to say to actually fire the gun.

Preferable, the projectile assembly includes a gas generating charge. Where this is so, conveniently the gas pressure from the propellant charge is not directly operable upon the projectile but operates on a ramming device which itself operates on the projectile.

The ramming device may be a slug of metal urged along a cylinder in the manner of a free piston or, alternatively, it could be telescopic.

Instead of gas pressure, a spring and latch can be used. In each case, it is preferably actuable by the firing arrangement of the gun.

Naturally, in any associated ammunition feed system, the projectile assembly is always paired with the propellant cartridge, the latter always following the former.

One embodiment of the invention is illustrated by way of example with reference to the accompanying drawings in which.

Figure 1:
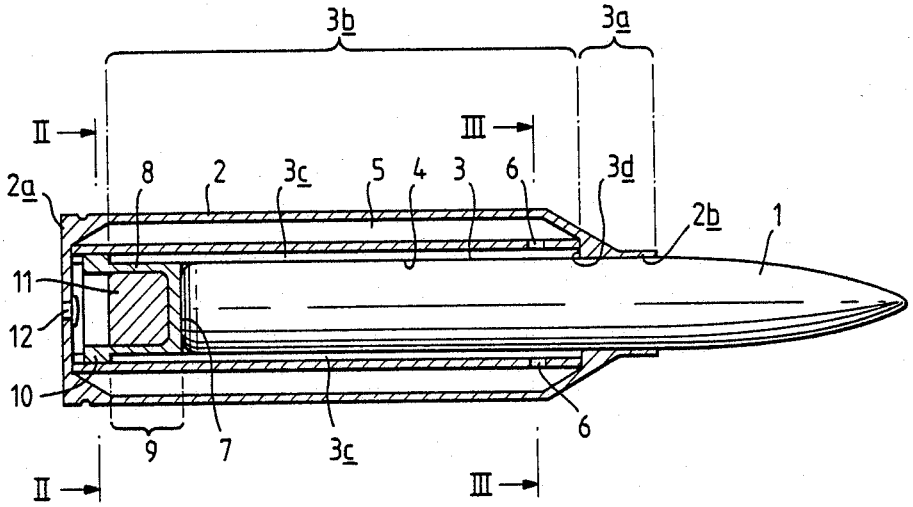
FIG. 1 is longitudinal cross section of a projectile assembly.
Figure 2:
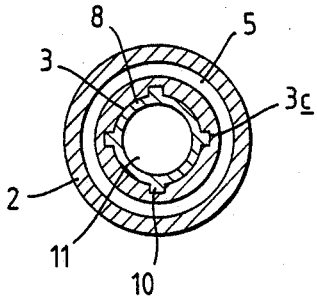
FIG. 2 is a transverse cross section on line II—II of FIG. 1.
Figure 3:
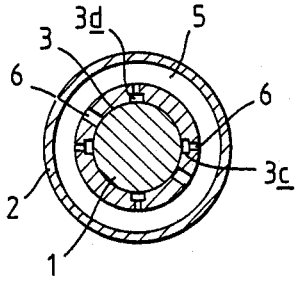
FIG. 3 is a transverse cross section on line III—III of FIG. 1.

In these drawings, a projectile 1 is carried in a carrier 2 to form a projectile assembly. The carrier 2 includes a closed end 2*a* and an open end 2*b* and an internal bearing surface 3 being a mating fit on a cylindrical exterior surface region 4 of the projectile. This bearing surface 3 is divided into two parts, that referenced 3*a* being of unbroken annular form and that referenced 3*b* being provided with grooves 3*c*, the grooves 3*c* lying longitudinally of the carrier and terminating at the bearing region 3*a* to form an abutment 3*d*.

Surrounding the bearing part 3*b* is an annular chamber 5 which communicates with that region within the bearing surface region 3*b* by means of one or more orifices 6.

At the rear of the projectile and packed tightly against its rear face 7 is a ramming slug 8. This has a body 9 of generally cylindrical form which engages and slides axially within the bearing surface 3 after the manner of a free piston. It is thus of the same diameter as the cylindrical region 4 of the projectile. At the rear of the body are provided radially extending protuberances 10 which slidably engage in the grooves of the bearing surface part 3*b* and, on such axially sliding movement will abut the fully annular surface, that is to say the abutment 3*d*, of the part 3*a*.

The slug 8 contains propellant charge 11 which in use is ignited by a percussion cap 12 positioned in the closed rear end 2*a* of the carrier 2 such that it is contactable by the existing firing mechanism of the gun, the ignited charge thus rapidly pressurising with gas the closed chamber formed by the bearing region 3, the closed rear end 2*a* of the carrier and the projectile 1 to cause the slug 8 and projectile to move axially along the carrier and the projectile to be ejected from the open end thereof.

In a typical gun having a breech mechanism and a barrel, which can be of an existing unmodified design, the apparatus functions as follows.

Assuming the projectile 1 is loaded into the projectile carrier 2, the assembly being as illustrated in the Figures, the assembly is fed into the gun by means of the breech mechanism. The gun is fired such that the firing mechanism contacts the percussion cap 12 which ignites the propellant charge 11 thereby urging the slug 8 axially within the carrier 2 by means of gaseous pressure until its protuberances contact the abutment 3*d*. By this movement, the projectile is urged out of the carrier, i.e. out of the breech, into the gun barrel. When the slug 8 reaches the orifices 6, the gaseous pressure (which until then is contained by the close fit of the slug body 9 and its protuberances 10 in the grooved bearing surface 3*b*) is released into the cavity 5 via the orifices 6 and is therefore dissipated in a controlled manner, so that the projectile is urged into the barrel by a predetermined distance. As an alternative a mechanical constraint could be provided to absorb any excess energy which would otherwise be passed to the projectile.

At this stage, the carrier 2 is removed from the breech mechanism and replaced by a propellant cartridge which is arranged to be the next item in the ammunition feed system associated with the gun. Firing of the gun causes the propellant cartridge to propel the projectile from the barrel whereupon the spent cartridge is ejected from the breech mechanism and replaced with the next projectile and carrier assembly in the ammunition feed.

It is to be noted that mechanically driven guns, for example the multi-barrel Gatling type, can accommodate the invention, but the rate of fire will be halved.

The invention can be used in both clip fed and belt fed ammunition. The invention can be used on non-automatic guns.

The projectile can be guided or unguided.

We claim:

1. A projectile assembly for insertion into a gun of the type having a breech and a barrel and which involves a double ramming technique wherein the assembly is inserted into the breech, the projectile is moved from the assembly into the barrel and the remaining part of the assembly ejected and replaced by a propellant cartridge, the assembly including:

a projectile carrier having an internal bearing surface defining an axially directed cylinder having an open forward end;

a projectile slidably engaging said surface;

means within said cylinder at the aft end of said projectile for urging the latter out of said open end;

means constraining said urging means for movement only within said cylinder; and means controlling said movement of said urging means and hence movement of said projectile from said carrier, whereby when said assembly is inserted into the breech of a gun, said projectile can be urged to a predetermined position in the barrel, and the spent projectile carrier subsequently removed from the breech to be replaced by a propellant cartridge which, when fired, propels said projectile from said predetermined position in the barrel.

2. A projectile assembly according to claim 1 wherein the urging means is actuatable by firing means associated with the gun in which the projectile assembly is inserted.

3. A projectile according to claim 1, wherein the urging means comprises a piston slidable in the cylinder and contacting the aft end of the projectile.

4. A projectile assembly according to claim 3 wherein the urging means includes a gas generating charge to move the piston.

5. A projectile assembly according to claim 3 wherein the constraining means comprises a longitudinal groove in the surface terminating in an abutment and a protrusion extending from the piston into said groove which, when the projectile is moved out of the carrier, engages said abutment.

6. A projectile assembly according to claim 4 in which the control means comprises an annular cavity in the carrier and a gas-escape orifice in the cylinder, through which generated gas can flow from within the cylinder, said cavity and orifice being positioned so that said cavity and orifice are opened at a predetermined point in the travel of the piston.

* * * * *